United States Patent [19]

El Taher

[11] 4,257,515

[45] Mar. 24, 1981

[54] TRANSPORTATION APPARATUS

[75] Inventor: Mohamed A. El Taher, Highland Township, Adams County, Pa.

[73] Assignee: Westinghouse Electric Corp., Pittsburgh, Pa.

[21] Appl. No.: 787,631

[22] Filed: Apr. 14, 1977

[51] Int. Cl.[3] ..... B66B 9/12

[52] U.S. Cl. ..... 198/333

[58] Field of Search ..... 198/324, 325, 333, 335, 198/337; 104/25

[56] References Cited

U.S. PATENT DOCUMENTS

| | | | |
|---|---|---|---|
| 898,794 | 9/1908 | Seeberger | 198/333 |
| 2,210,711 | 8/1940 | Dunlop | 198/325 |
| 2,981,397 | 4/1961 | Hansen | 198/333 |

FOREIGN PATENT DOCUMENTS

| | | | |
|---|---|---|---|
| 660506 | 2/1964 | Italy | 198/335 |

*Primary Examiner*—Joseph E. Valenza

*Attorney, Agent, or Firm*—D. R. Lackey

[57] ABSTRACT

Transportation apparatus for transporting persons between spaced upper and lower landings, including a plurality of steps mounted for articulation between step and platform modes. Motion markers are disposed on the riser part of at least certain of the steps which appear and disappear responsive to articulation.

8 Claims, 4 Drawing Figures

TRANSPORTATION APPARATUS

BACKGROUND OF THE INVENTION

1. Field of the Invention

The invention relates in general to transportation apparatus, and more specifically to moving stairways or escalators for transporting people between upper and lower landings.

2. Description of the Prior Art

A moving stairway or escalator includes a plurality of steps mounted for articulation between step formation or mode on the load bearing run of the stairway, and platform formation or mode at each end of the load bearing run adjacent to the upper and lower landings.

U.S. Pat. Nos. 2,210,711 and 2,981,397 disclose step constructions which aid passengers in properly placing their feet on the steps while the steps are in platform mode. These step constructions include insert members in the step tread which more clearly mark the demarcation between adjacent steps. The demarcation strips are visible, primarily from above, during platform mode, step mode, and during the transitions between the platform and step modes.

French Pat. No. 1,340,585 discloses marking the handrails of an escalator at spaced locations to aid prospective passengers in determining the travel direction of an escalator.

SUMMARY OF THE INVENTION

The present invention is a new and improved moving stairway which provides motion markers on the riser parts of the steps, which markers have a contrastingly different appearance from the surrounding riser and tread parts. The motion markers are located such that they appear, or disappear when viewed from the lower landing, responsive to articulation of the steps between the step mode and the platform mode. The motion markers suddenly disappear on a downwardly moving stairway as the steps each successively start the transition from step-to-platform mode at the same point of stairway travel. The sudden disappearance of the motion marker provides a "flashing" type of motion signal which quickly alerts someone approaching a downwardly moving stairway at the lower landing that the stairway should not be entered. Sudden appearances of the motion marker, on the other hand, on an upwardly moving stairway as each step nears the completion of the transition from platform-to-step mode, provide a different type of "flashing" signal, visible to someone approaching the stairway from the lower landing. The signal, appearing at the end of the transition, instead of at the start of the transition, enables a prospective passenger to quickly confirm that the stairway is moving upwardly and may be entered.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
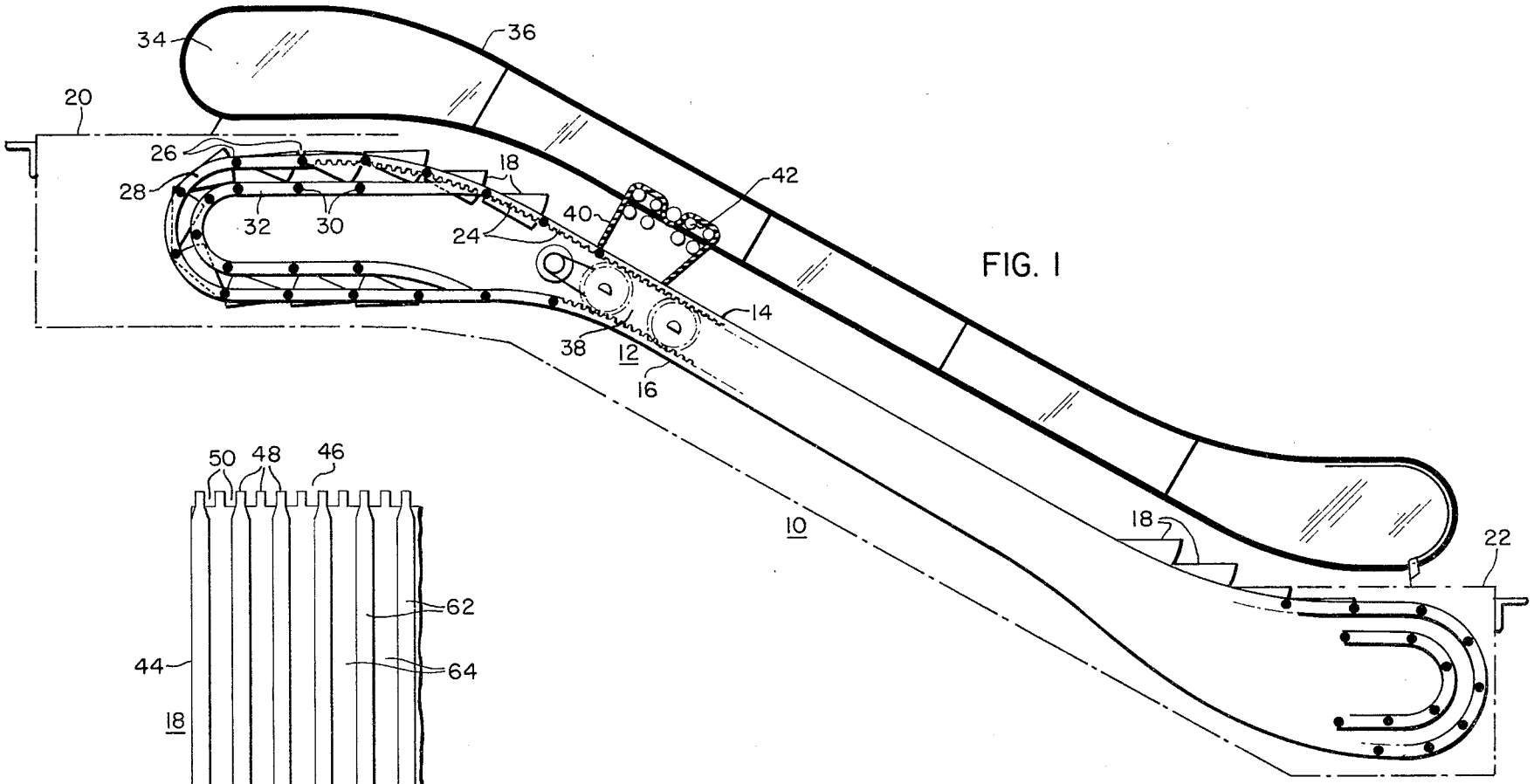
FIG. 1 is a diagrammatic side elevational view of a moving stairway of the type which may utilize the teachings of the invention.

Referring now to the drawings, and to FIG. 1 in particular, there is shown a moving stairway or escalator 10 which may utilize the teachings of the invention. Stairway 10 includes an endless, flexible conveyor unit 12 driven in a loop which includes an upper load bearing run 14 and a lower return run 16. A plurality of steps are mounted on the conveyor unit 12 for articulation between a step mode on the load bearing run and platform modes adjacent upper and lower landings 20 and 22, respectively.

The steps 18 are each clamped to step axles 19 (shown in FIG. 2) which are part of the conveyor unit 12, and the conveyor unit 12 is driven about the endless loop by suitable drive means. The conveyor unit 12 may be driven in a conventional manner, such as illustrated in U.S. Pat. No. 3,414,109, or it may be driven by the modular drive arrangement disclosed in U.S. Pat. No. 3,677,388, both of which are assigned to the same assignee as the present application. For purposes of example, the modular drive arrangement is shown in FIG. 1.

As disclosed in U.S. Pat. No. 3,677,388, the conveyor unit 12 includes a pair of horizontally spaced endless belts constructed of toothed links 24, with the spaced endless belts being interconnected by the step axles 19 to which the steps 18 are connected. Each belt is supported by guide and support rollers or wheels 26 on the ends of the step axles 19 which cooperate with guide tracks 28. The steps 18 additionally include trail wheels or rollers 30 which cooperate with trailer guide tracks 32 which aid in supporting the steps 18 and which also direct each step between the step and platform modes at the proper locations in the travel path. A balustrade 34 is disposed above the conveyor unit 12, on each side thereof, for guiding a continuous flexible handrail 36. The balustrade 34 may be transparent, as indicated, or opaque as desired.

The conveyor unit 12 and attached steps 18 are driven by a modular drive unit 38 which engages the toothed links 24. The modular drive unit 38 is linked to handrail drive units disposed on each side of the conveyor unit 12, such as via a handrail drive pulley 40 disposed to drive a handrail drive unit 42.

Figure 3:
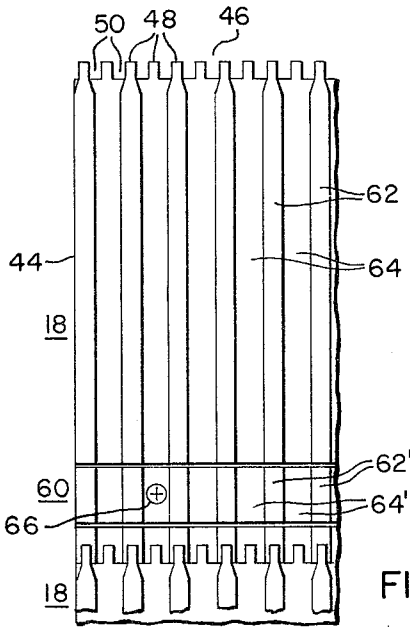
FIG. 3 is a front elevational view of the steps shown in FIG. 2, taken in the direction of arrows III—III.
Figure 2:
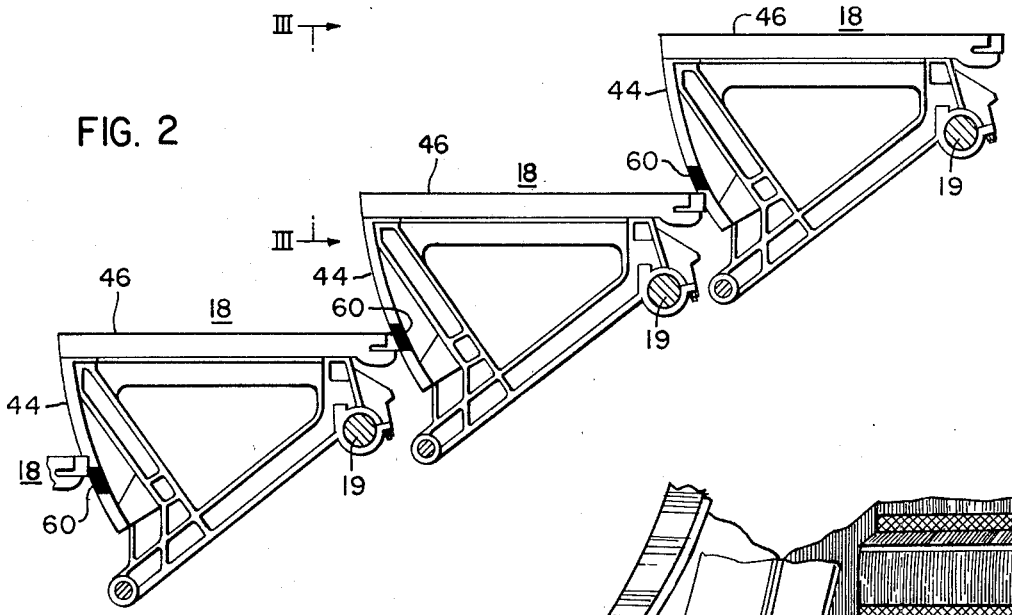
FIG. 2 is a side elevation of a plurality of steps of the moving stairway shown in FIG. 1, constructed according to the teachings of the invention, with the steps being illustrated during a predetermined portion of the transition between step and platform formation.
Figure 4:
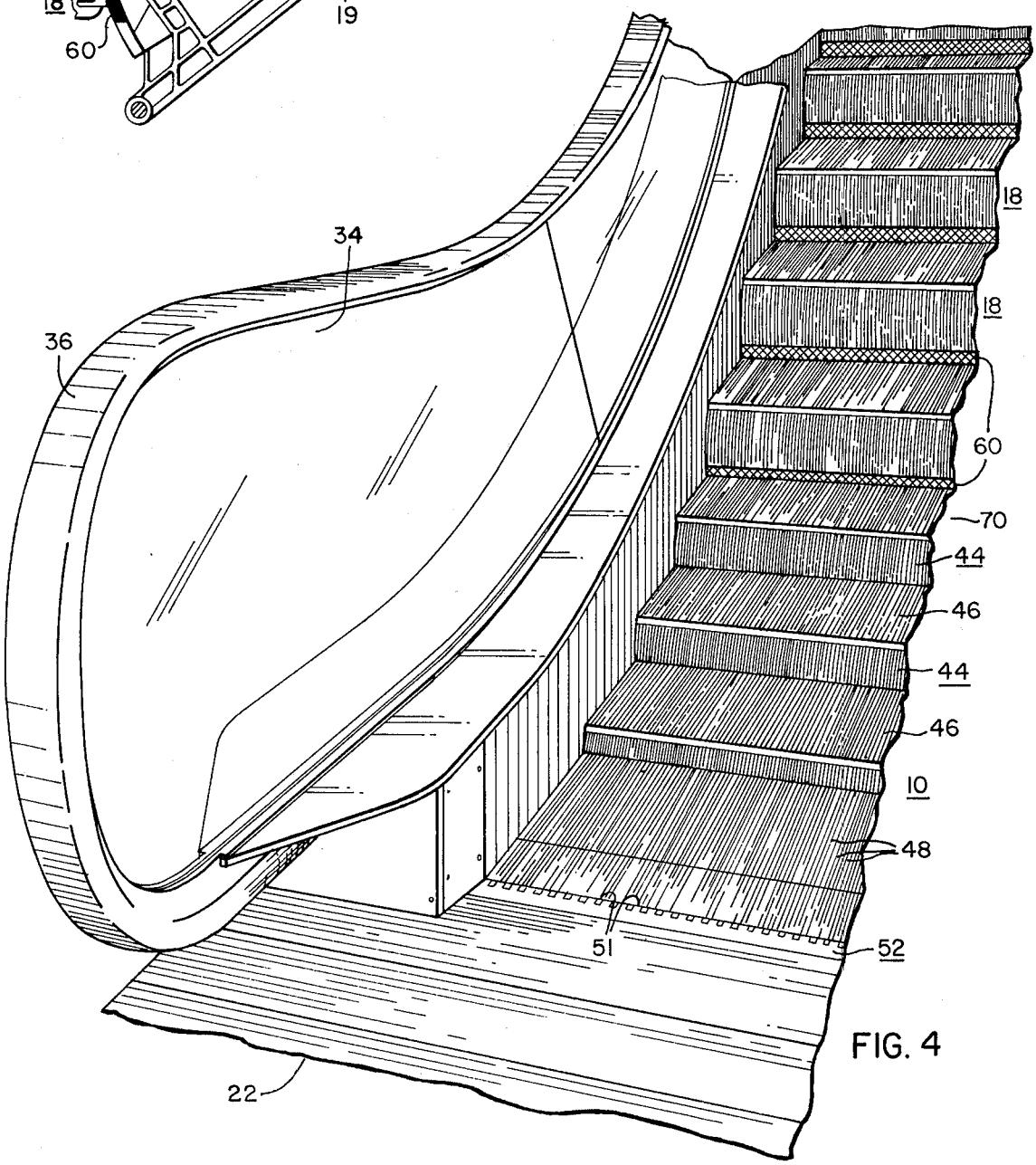
FIG. 4 is a perspective view of the moving stairway shown in FIG. 1, viewing the moving stairway from the lower landing, with the steps thereof being constructed as shown in FIGS. 2 and 3.

Referring now to FIGS. 2, 3 and 4 which illustrate side and front elevational views, and a perspective view, respectively, of steps 18 constructed according to the teachings of the invention, each step 18 includes a riser part 44 and a tread part 46. Each tread part 46 is provided with a plurality of spaced, upstanding cleats 48, which define grooves 50 extending in the direction of stairway travel. The cleats 48 and grooves 50 mesh with the teeth 51 of a combfinger assembly 52 at each landing, best shown in FIG. 4.

At least certain of the riser parts 44, and in a preferred embodiment all of the riser parts, include a motion marker 60 disposed to appear and disappear in response to articulation of the steps 18 between platform and step formation.

The motion marker 60 is preferably narrow in the vertical direction, such as in the range from about 0.5 inch to 2 inches, and it preferably extends across the complete width of the step. It is located on the riser part 44 such that when the associated step is in step mode it is closer to the tread part 46 of the immediately adjacent lower step than it is to the tread part of its own step. In a preferred embodiment it is located immediately above the tread part 46 of the immediately adjacent lower step. In this location it will immediately disappear behind the adjacent step, on a descending stairway, at the start of the transition of the associated step from step-to-platform mode; and, it will be the last portion of the riser part to appear on an ascending stairway, as the associated step completes the transition from platform mode to the step mode and exposes the motion marker 60.

The sudden disappearance of the motion marker 60 behind the adjacent step, at the start of the transition for a downwardly moving stairway and the sudden appearance of the motion marker 60 at the end of a transition for an upwardly moving stairway, provides the essential visual distinction necessary to properly inform a prospective passenger approaching the stairway from the lower landing, as to the stairway travel direction. Each travel direction of the stairway provides a flashing type signal, as the motion marker suddenly disappears, or suddenly appears, but the visual effect of each signal is markedly different from the other. There is no mistaking the successive disappearances of the moving motion marker 60 as an indication that the steps 18 are moving toward the lower landing and are collapsing from the step to the platform mode, in order to unload any passengers thereon. While the motion marker 60 may be in the form of paint disposed on the conventional riser part of a step, with the paint having a color which contrasts with the color of the surrounding riser and tread parts, paint may become soiled and/or peel over a period of time, reducing the effectiveness of the motion marker. In a preferred embodiment of the invention, best illustrated in FIGS. 2 and 3, the motion marker 60 is in the form of a separate discrete insert member which is removably attached to a riser part 44 which has been modified to receive the insert.

The discrete motion marker 60 is preferably constructed of a material which has a contrastingly different appearance from the associated metallic riser part, and adjacent tread part, with the riser and tread parts conventionally being constructed of metal, such as aluminum. For example, the motion marker 60 is preferably constructed of a non-metallic material, such as nylon or other suitable plastic material, which is formulated to provide a predetermined color, such as yellow.

If the associated riser part 44 is cleated, having a plurality of cleats 62 and grooves 64, for meshing with the cleats 48 of the tread part 46, the motion marker 60 preferably includes cleats 62' and grooves 64' which are aligned with the cleats 62 and grooves 64, respectively, of the associated riser part 44.

As illustrated in FIG. 3, the riser part 44 is preferably formed with an integral groove for removably receiving the motion marker 60, with the motion marker 60 being attached to the riser part via suitable fastening means such as a screw 66 which extends through an opening in the motion marker 60 to threadly engage a tapped opening in the grooved portion of the riser part 44.

FIG. 4 is a perspective view of the lower landing 22 of the movable stairway 10 shown in FIG. 1, which illustrates the transition of the steps 18 from the step mode to the platform mode. If the stairway 10 is descending, each motion marker 60 will start to disappear at location 70 of the stairway, at the very start of the transition, providing a flashing type motion signal at location 70 which signifies a downwardly moving stairway. If the stairway 10 is ascending, each motion marker 60 will start to appear from behind the adjacent step at location 70 of the stairway during the final stage of the transition, providing a flashing type motion signal at location 70 which signifies an upwardly moving stairway. The motion markers additionally function to provide a demarcation between the associated riser part and the tread part of the adjacent step.

I claim as my invention:

1. A moving stairway extending between upper and lower landings, comprising:

an endless flexible unit, drive means for driving said unit in a loop which includes an upper load bearing run and a lower return run, a plurality of steps mounted on said unit for articulation between a step mode on the load bearing run and a platform mode adjacent each landing, each of said steps having a tread part and a riser part, and marker means on at least certain of said riser parts, said marker means on a riser part being exposed when the associated step is in step mode, and covered by an adjacent step during the transition of the step between said step mode and said platform mode, said marker means being substantially closer to the tread part of an adjacent step than to the tread part of its associated step, when said steps are in step mode, such that said marker means disappear substantially at the start of step articulation for descending steps approaching the lower landing, and appear substantially at the end of articulation for ascending steps leaving the lower landing, said marker means providing motion and direction markers responsive to step articulation for prospective passengers attempting to enter the stairway from the lower landing, with the motion and direction marker creating visually different "flashing" effects responsive to descending and ascending steps when viewed from the lower landing, as the marker means suddenly and sequentially disappear on descending steps, and suddenly and sequentially appear on ascending steps.

2. The moving stairway of claim 1 wherein the marker means is located on a riser part such that it is immediately above the tread part of the adjacent lower step when the associated step has completed the transition from platform mode to step mode.

3. The moving stairway of claim 1 wherein the marker means is in the form of an insert member which is removably attached to a riser part.

4. The moving stairway of claim 1 wherein each riser part includes a plurality of cleats and grooves, and the marker means is an insert member having a plurality of cleats and grooves which are longitudinally aligned with the cleats and grooves of the associated riser part.

5. The moving stairway of claim 1 wherein each tread part and each riser part include spaced cleats and grooves, with the ends of the tread cleats of one step extending into the grooves of the riser part of the immediately adjacent step, and wherein the marker means is an insert member having spaced cleats and grooves longitudinally aligned with the cleats and grooves, respectively, of the associated riser part.

6. The moving stairway of claim 1 wherein the riser part is a metallic member and the marker means is a discrete member formed of a non-metallic material.

7. The moving stairway of claim 1 wherein the marker means is contrastingly different in appearance from the associated riser part.

8. The moving stairway of claim 1 wherein the marker means is an insert member formed of a non-metallic material which is contrastingly different in appearance from the appearance of the associated riser part.

* * * * *